US012146203B2

(12) United States Patent
Majka

(10) Patent No.: US 12,146,203 B2
(45) **Date of Patent: *Nov. 19, 2024**

(54) CORROSION PITTING RESISTANT MARTENSITIC STAINLESS STEEL AND METHOD FOR MAKING SAME

(71) Applicant: General Electric Company, Schenectady, NY (US)

(72) Inventor: Theodore Francis Majka, Simpsonville, SC (US)

(73) Assignee: GE Infrastructure Technology LLC, Greenville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/115,057

(22) Filed: Feb. 28, 2023

(65) Prior Publication Data

US 2023/0227929 A1 Jul. 20, 2023

Related U.S. Application Data

(63) Continuation of application No. 17/196,303, filed on Mar. 9, 2021, now Pat. No. 11,697,857.

(51) Int. Cl.
*C21D 9/00* (2006.01)
*C21D 1/613* (2006.01)
(Continued)

(52) U.S. Cl.
CPC ..... *C21D 9/0068* (2013.01); *C21D 1/613* (2013.01); *C21D 6/004* (2013.01); *C22C 38/44* (2013.01);
(Continued)

(58) Field of Classification Search
CPC ..... C22C 38/22; C21D 1/613; C21D 6/04
See application file for complete search history.

(56) References Cited

U.S. PATENT DOCUMENTS 7,828,910 B2 11/2010 Benn
7,879,159 B2 * 2/2011 Wright ..... C22C 38/06 420/68
(Continued)

FOREIGN PATENT DOCUMENTS

CN 113322415 * 8/2021
CN 113322415 A 8/2021
EP 3061841 A1 8/2016

OTHER PUBLICATIONS

Baldissera, P. et al. "Deep Cryogenic Treatment: A Bibliographic Review." 20008. Open mechanical engineering journal. 2. p. 1-11. (Year: 2008).*
(Continued)

*Primary Examiner* — Nicholas A Wang
(74) *Attorney, Agent, or Firm* — James Pemrick; Charlotte Wilson; Hoffman Warnick LLC

(57) ABSTRACT

A method of making a forged, martensitic, stainless steel alloy is provided. The alloy is a forged preform of martensitic, pitting corrosion resistant stainless steel alloy comprising, by weight: 12.0 to 16.0 percent chromium; greater than 16.0 to 20.0 percent cobalt, 6.0 to 8.0 percent molybdenum, 1.0 to 3.0 percent nickel, 0.02 to 0.04 percent carbon; and the balance iron and incidental impurities. The alloy has a microstructure that comprises a retained austenite phase less than or equal to 2 percent by volume of the microstructure. The method heats the preform to a solutionizing temperature to form a solutionized microstructure. The preform is cooled with a liquid to room temperature at a rate of no less than 0.25° C./sec. to prevent formation of sigma phase. The preform is immersed in a cryo-liquid to transform the retained austenite phase in the microstructure to
(Continued)

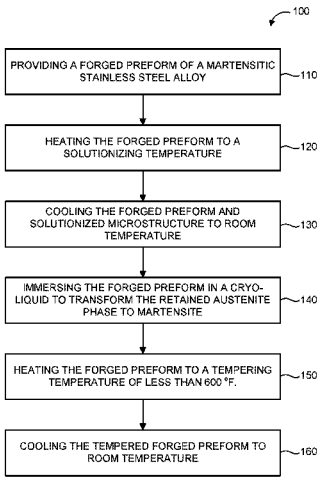

martensite. The preform is heated to a temperature of less than 600° F. for a time sufficient to form a tempered forged preform.

8 Claims, 1 Drawing Sheet

(51) Int. Cl.
*C21D 6/00* (2006.01)
*C22C 38/44* (2006.01)
*C22C 38/52* (2006.01)

(52) U.S. Cl.
CPC ..... *C22C 38/52* (2013.01); *C21D 2211/008* (2013.01)

(56) References Cited

U.S. PATENT DOCUMENTS

| | | | | |
|---|---|---|---|---|
| 8,034,197 | B2 | 10/2011 | Garrison, Jr. | |
| 2008/0277030 | A1 | 11/2008 | Cooper | |
| 2009/0081068 | A1 | 3/2009 | Garrison | |
| 2016/0025173 | A1 | 1/2016 | Wagner et al. | |
| 2016/0251737 | A1* | 9/2016 | Majka ..... | C21D 8/005 148/605 |
| 2018/0100210 | A1 | 4/2018 | Majka | |

OTHER PUBLICATIONS

ASM Handbook. vol. 4a. "Quenching of steel". Steel Heat treating fundamentals and processes. 2013. p. 91-157. (Year: 2013).*

PCT International Search Report for Application No. PCT/US2022/070930, Jun. 8, 2022.

Totten, G.E. et al.; "Quenching of Steel"; ASM Handbook; Steel Heat Treating Fundamentals and Processes; vol. 4A; Copyright 2013 ASM International; pp. 91-157.

Angelini, E. et al.; "Microstructural evolution and localized corrosion resistance of an aged superduplex stainless steel"; Elsevier; Corrosion Science 46; 2004; Copyright 2003 Elsevier Ltd.; pp. 1351-1367.

Non Final Office Action mailed Aug. 1, 2022 for U.S. Appl. No. 17/196,303, filed Mar. 9, 2021; pp. 20.

Final Office Action mailed Dec. 14, 2022 for U.S. Appl. No. 17/196,303, filed Mar. 9, 2021; pp. 12.

Baldissera, P. et al.; "Deep Cryogenic Treatment: A Bibliographic Review"; 2008; The Open Mechanical Engineering Journal 2; pp. 1-11; 2008 Bentham Science Publishers Ltd.

Notice of Allowance and Fee(s) Due mailed Mar. 1, 2023 for U.S. Appl. No. 17/196,303, filed Mar. 9, 2021; pp. 8.

International Preliminary Report on Patentability mailed Nov. 13, 2023 for Application PCT/US2022/070930 filed Mar. 3, 2022; pp. 7.

* cited by examiner

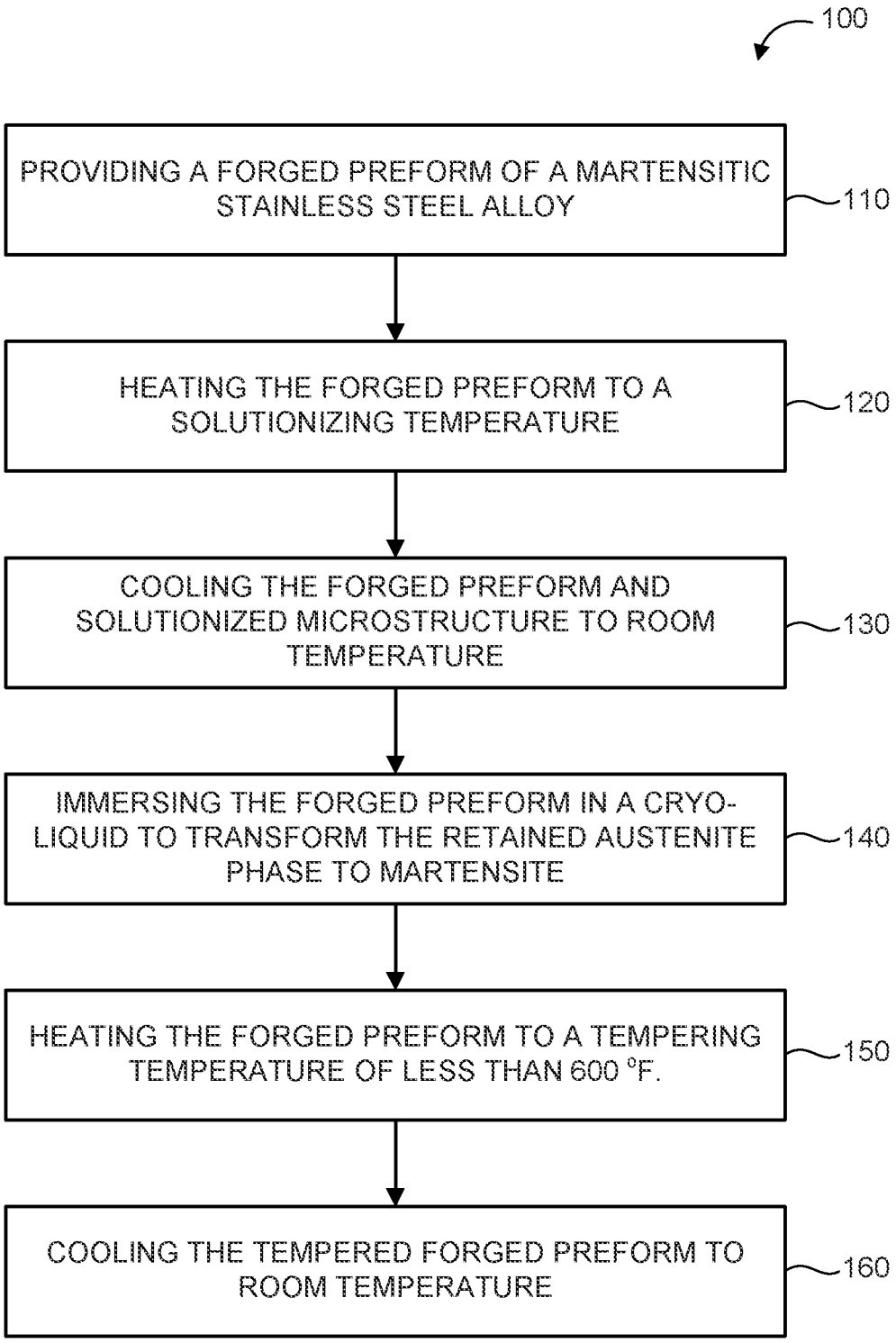
100
PROVIDING A FORGED PREFORM OF A MARTENSITIC STAINLESS STEEL ALLOY
110
HEATING THE FORGED PREFORM TO A SOLUTIONIZING TEMPERATURE
120
COOLING THE FORGED PREFORM AND SOLUTIONIZED MICROSTRUCTURE TO ROOM TEMPERATURE
130
IMMERSING THE FORGED PREFORM IN A CRYO-LIQUID TO TRANSFORM THE RETAINED AUSTENITE PHASE TO MARTENSITE
140
HEATING THE FORGED PREFORM TO A TEMPERING TEMPERATURE OF LESS THAN 600 °F.
150
COOLING THE TEMPERED FORGED PREFORM TO ROOM TEMPERATURE
160

CORROSION PITTING RESISTANT MARTENSITIC STAINLESS STEEL AND METHOD FOR MAKING SAME

BACKGROUND

The subject matter disclosed herein generally relates to corrosion resistant stainless steels. More particularly, it relates to corrosion pitting resistant, martensitic, stainless steels, including those suitable for turbine rotating components.

The metal alloys used for rotating components of a gas turbine, particularly the front stage compressor airfoils, including rotating and stationary blades, must have a combination of high strength, toughness, fatigue resistance and other physical and mechanical properties in order to provide the required operational properties of these machines. In addition, the alloys used must also have sufficient resistance to various forms of corrosion and corrosion mechanisms, particularly pitting corrosion, due to the extreme environments in which turbines are operated, including exposure to various ionic reactant species, such as various species that include chlorides, sulfates, nitrides and other corrosive species. Corrosion can also diminish the other necessary physical and mechanical properties, such as the high cycle fatigue strength, by initiation of surface cracks that propagate under the cyclic thermal and stresses associated with operation of the turbine.

At present, there are no high-strength steels available that sufficiently resist corrosion pitting to survive harsh marine/industrial environments, such as coastal industrial power plants, for more than 2-3 years. Even alloys that are known to have many advantageous corrosion resistance properties, including resistance to intergranular attack, such as 450 and 450+ stainless steel, are still susceptible to corrosion pitting mechanisms. While these martensitic stainless steels have provided a combination of corrosion resistance, mechanical strength and fracture toughness properties sufficient to make them suitable for use in rotating steam and gas turbine components, these alloys are still known to be susceptible to corrosion pitting phenomena. For example, stainless steel airfoils, such as those used in the front stage compressors of industrial gas turbines, have shown susceptibility to corrosion pitting on the surfaces, particularly the leading edge surface, of the airfoil. Without being limited by theory, corrosion pitting is believed to be associated with various electrochemical reaction processes enabled by airborne deposits, especially corrosive species present in the deposits, and moisture from intake air on the airfoil surfaces. Electrochemically-induced corrosion pitting phenomena occurring at the airfoil surfaces can in turn result in cracking of the airfoils due to the cyclic thermal and operating stresses experienced by these components. High levels of moisture can result from various sources, including use in high moisture environments, such as facilities located near oceans or other bodies of water, as well as on-line water washing, fogging, evaporative cooling, or various combinations thereof, to enhance compressor efficiency. Corrosive contaminants usually result from the environments in which the turbines are operating because they are frequently placed in highly corrosive environments, such as those near chemical or petrochemical plants, where various chemical species may be found in the intake air, or those at or near ocean coastlines or other saltwater environments where various sea salts may be present in the intake air, or combinations of the above, or in other applications where the inlet air contains corrosive chemical species.

In view of the above, stainless steel alloys suitable for use as turbine airfoils, particularly industrial gas turbine airfoils, in the operating environments described and having improved resistance to corrosion pitting are very desirable.

BRIEF DESCRIPTION

According to one aspect a method of making a forged, martensitic, stainless steel alloy is provided. The method includes providing a forged preform of martensitic, pitting corrosion resistant stainless steel alloy comprising, by weight: about 12.0 percent to about 16.0 percent chromium; greater than 16.0 percent to about 20.0 percent cobalt, about 6.0 percent to about 8.0 percent molybdenum, about 1.0 percent to about 3.0 percent nickel, about 0.020 percent to about 0.040 percent carbon; and the balance iron and incidental impurities. The alloy has a microstructure that comprises a retained austenite phase of less than 2 percent by volume, or less than or equal to 2 percent, of the microstructure. A heating step heats the forged preform to a solutionizing temperature for a time sufficient to form a solutionized microstructure. A cooling step cools the forged preform and solutionized microstructure with a liquid to room temperature, and subsequently; an immersing step immerses the forged preform in a cryo-liquid to transform the retained austenite phase in the microstructure to martensite. A heating step heats the forged preform to a tempering temperature of less than 600° F. for a tempering time sufficient to form a tempered forged preform comprising a tempered martensitic microstructure; and a cooling step cools the tempered forged preform to room temperature.

According to another aspect, a method of making a forged, martensitic, stainless steel alloy is provided. The method provides a forged preform of martensitic, pitting corrosion resistant stainless steel alloy comprising, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities. The alloy has a microstructure that comprises a retained austenite phase less than or equal to 2 percent by volume of the microstructure. A heating step heats the forged preform to a solutionizing temperature for a time sufficient to form a solutionized microstructure. A cooling step cools the forged preform and solutionized microstructure with a liquid to room temperature, and the liquid is an oil. The forged preform is immersed in the oil, and subsequently; and immersing step immerses the forged preform in a cryo-liquid to transform the retained austenite phase in the microstructure to martensite. The cryo-liquid is liquid nitrogen or liquid helium, and is at a temperature of less than −300° F. A second heating step heats the forged preform to a tempering temperature of less than 600° F. for a tempering time sufficient to form a tempered forged preform comprising a tempered martensitic microstructure. A second cooling step cools the tempered forged preform to room temperature.

According to yet another aspect, a forged, martensitic, stainless steel alloy comprises, by weight: about 12.0 percent to about 16.0 percent chromium; greater than 16.0 percent to about 20.0 percent cobalt, about 6.0 percent to about 8.0 percent molybdenum, about 1.0 percent to about 3.0 percent nickel, about 0.020 percent to about 0.040 percent carbon; and the balance iron and incidental impurities. The alloy has a microstructure that comprises a retained austenite phase less than or equal to 2 percent by volume of the microstructure. The alloy has a microstructure that comprises substantially no sigma phase. The alloy has a microstructure that contains substantially no laves phase, no chi phase, and no delta ferrite phase. The alloy may be a turbine airfoil preform or a compressor airfoil preform.

According to another aspect, a forged, martensitic, stainless steel alloy comprises, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities. The alloy has a microstructure that comprises substantially no sigma phase.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the aspects described herein are apparent from the following detailed description taken in conjunction with the accompanying drawing in which:

FIG. 1 is a flow chart of an embodiment of a method of making the martensitic stainless alloys disclosed herein.

The detailed description explains various embodiments, together with advantages and features, by way of example with reference to the drawing.

DETAILED DESCRIPTION

Corrosion pitting as described above is presently observed in service on front stage compressor airfoils. The corrosion pitting resistant, martensitic, stainless steel alloys and methods described herein provide an iron-based, corrosion and pitting resistant material that is a significant enhancement for many heavy marine and industrial applications that are susceptible to corrosion pitting phenomena as described above, including front stage turbine compressor airfoils, in regards to service reliability, reduction of maintenance concerns and costs, and avoidance of unplanned downtime due to airfoil failures. The stainless steel alloys described herein specifically have greater resistance to corrosion pitting than GTD-450 and GTD-450+ stainless steels. Due to the significant operational costs associated with downtime of an industrial gas turbine, including the cost of purchased power to replace the output of the turbine, as well as the maintenance cost of dismantling the turbine to effect repair or replacement of the airfoils and the repair or replacement costs of the airfoils themselves, the enhancements in corrosion pitting resistance of the alloys and methods of making them have significant commercial value. An additional benefit of the corrosion pitting resistant iron-base alloys and methods of making them is that they do not require the addition of separate coatings for corrosion pitting protection. The stainless steel alloys described herein are particularly configured and well suited for forging, particularly the forging of turbine airfoil articles.

In an exemplary embodiment, a forged, martensitic, stainless steel alloy includes, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities. More particularly, the forged, martensitic, stainless steel alloy includes, by weight: about 13.5 to about 14.5 percent chromium; greater than 16.0 to about 20.0 percent cobalt, about 6.0 to about 6.5 percent molybdenum, about 1.0 to about 3.0 percent nickel, about 0.020 to about 0.30 percent carbon; and the balance iron and incidental impurities. Even more particularly, the forged, martensitic, stainless steel alloy includes, by weight: about 14 percent chromium; greater than 16.0 to about 20.0 percent cobalt, about 6.0 molybdenum, about 1.0 to about 3.0 percent nickel, about 0.025 carbon; and the balance iron and incidental impurities. The stainless steel alloy composition is selected and configured to provide a martensitic microstructure by heat treatment as described herein. The stainless steel alloy composition is selected and configured to provide a martensitic stainless steel alloy with a minimum tensile strength of about 150 ksi, a molybdenum content of greater than 6%, and a pitting resistance equivalent number, or PREN, of greater than about 31.8. The stainless steel alloys disclosed herein achieve these corrosion and strength properties by a combination of compositional chemistry and heat treatment. For example, the stainless steel alloys disclosed herein exhibit exceptional resistance to corrosion pitting and may be heat treated to provide high strength and fracture toughness suitable for application as early stage turbine compressor airfoils (e.g. stages 1 through stage 5), including both blades and vanes, for industrial gas turbines. In another aspect, the stainless steel alloys described herein obtain strength primarily from the development of a martensitic microstructure and solid solution strengthening in conjunction with the martensitic reaction, while also reducing or minimizing the amount of retained austenite, and having substantially no delta ferrite, which in an embodiment also includes no delta ferrite. High amounts of retained austenite (e.g., greater than 2%) have proven to be detrimental to corrosion resistance, and a limit of 2% maximum (i.e., less than 2%, or less than or equal to 2%, retained austenite) is preferred.

The pitting resistance equivalent number provides a guideline for comparing the corrosion pitting resistance (PREN) of stainless steel alloys based on alloy chemistry. The higher the PREN the more resistance to corrosion pitting, but there are practical limits to how much the value can be increased before the ability to successfully heat treat the alloy is compromised. The PREN may be calculated using equation 1 below.

$$\text{PREN}=(\%\ \text{Cr})+3.3(\%\ \text{Mo})+16(\%\ \text{N}) \quad (1)$$

The martensitic stainless steel alloys described herein have a PREN greater than about 31.8, and more particularly greater than about 33.3. In one embodiment, the PREN ranged from greater than about 31.8 to about 42.4, and more particularly about 33.3 to about 36.0.

The stainless steel alloys disclosed herein may be described as iron-based alloys comprising five alloy constituents, including Cr, Mo, Co, Ni, and C. All other elements are impurities incidental to the manufacture of stainless steel, and may include, in weight percent, Mn (0.25 max.), Al (0.03 max.), V (0.10 max.), Si (0.25 max.), S (0.005 max.), or P (0.02 max.), for example, and are kept below the maximum prescribed levels described herein to ensure the consistency of properties and microstructure from lot to lot. When balanced within the stated ranges the disclosed stainless steel alloys provide a martensitic microstructure with the desired strength and fracture toughness levels along with corrosion pitting resistance.

As noted, Cr (chromium) is a required constituent and will be present in an amount sufficient to form a passive film of chromium oxide on the alloy surface. In one embodiment, Cr is present in an amount of at least about 11.5 weight percent. In another embodiment, Cr is present in an amount of about 12 to about 16 weight percent, and more particularly about 13.5 to about 14.5 weight percent, and even more particularly about 14 weight percent.

As indicated by equation 1, Mo (molybdenum) has a larger effect than Cr on the corrosion pitting resistance of stainless steel. In one embodiment, Mo is present in an amount of about 6.0 to about 8.0 weight percent, and more particularly about 6.0 to about 6.5 weight percent, and even more particularly about 6 weight percent. At least about 6 weight percent is required to ensure sufficient resistance to pitting in marine, chloride environments. Studies have shown that Mo enhances the repassivation capability of stainless steel. Conventional high Mo content stainless steels are typically either ferritic grades or austenitic grades with high Ni (nickel) levels. Martensitic high Mo content stainless steel grades that have been investigated have generally focused on exploiting the ultra-high strength capabilities present in high-temperature tempered materials and have been designed and heat treated at high tempering temperatures, such as 1,100° F., for use at elevated operating temperatures. However, in these materials corrosion resistance and toughness is sacrificed at the high tempering temperatures due to the precipitation and formation of Mo-rich and Cr-rich intermetallic phases, which deplete the matrix of the corrosion resisting elements Mo and Cr. At high tempering temperatures a secondary hardening effect also occurs due to formation of these intermetallic compounds. The intermetallic phases include the laves phase ($Fe_2Mo$), $Fe_7Mo_6$, FeMo, the sigma phase (Fe—Cr—Mo), and a complex BCC chi phase (Fe—Cr—Mo). Sigma phase can form during quenching and tempering and is an undesirable microconstituent. Cobalt does not participate in the phases associated with these precipitation reactions. These intermetallic phases also drastically decrease the toughness of the alloy. Thus, martensitic stainless alloys described herein are tempered at low tempering temperatures as described herein to avoid the precipitation of these intermetallic phases. The tempered alloys are suitable for use in relatively lower temperature applications where corrosion resistance with moderate strength and good toughness are important. The martensitic stainless alloys described herein balance high Mo additions with the low-tempering temperature region of the hardness vs. tempering temperature curve to avoid the formation of intermetallic phases and keep Mo and Cr in solution to maintain a high level as toughness. In one embodiment, the microstructure of the martensitic stainless steel alloys contain substantially no laves phase, which in an embodiment also includes no laves phase. In another embodiment, the microstructure of the martensitic stainless steel alloys contain substantially no chi phase, which in an embodiment also includes no chi phase. In yet another embodiment, the microstructure of the martensitic stainless steel alloys contain substantially no delta ferrite phase, which in an embodiment also includes no delta ferrite phase. In another embodiment, the microstructure of the martensitic stainless steel alloys contain substantially no sigma phase, which in an embodiment also includes no sigma phase. In still another embodiment, the microstructure of the martensitic stainless steel alloys contain substantially no laves phase, no chi phase, no delta ferrite phase, and no sigma phase which in an embodiment also includes no laves phase, no chi phase, no delta ferrite phase, and no sigma phase.

As will also be understood from equation 1, N has a large effect on the PREN, and may optionally be included in the claimed stainless steel materials. However, N is difficult to add in significant amounts in vacuum melted materials. In addition, N can also combine with Cr in the alloy microstructure to form chromium nitrides, which can embrittle and sensitize the stainless steel materials by local depletion of chromium within the alloy microstructure, particularly at the alloy surface, where contact with corrosive species is possible, as described herein. Thus, where present, N will generally be present in amount of 0.02 weight percent or less, and more particularly about 0.001 to about 0.02 weight percent.

The development of a martensitic microstructure from the martensite transformation requires a high temperature austenitic microstructure. Thus, the composition of the claimed stainless steel alloys will have a high temperature microstructure that includes austenite. Since both Cr and Mo are ferrite stabilizers, consequently, an austenite former is required to balance the phase diagram and develop a high temperature austenite phase to facilitate a martensitic heat treatment and provide the martensitic microstructure, while also developing a predetermined maximum amount of retained austenite and substantially no delta ferrite, which in an embodiment also includes no delta ferrite. Retained austenite is undesirable in this alloy and should be kept below 2% maximum. Co was selected to stabilize austenite. In one embodiment, Co is present in an amount of about 16.0 to about 20.0 weight percent, and more particularly about 16.5 to about 20.0 weight percent, and even more particularly about 16.5 to about 18.0 weight percent. As an austenite stabilizer, cobalt provides a sufficiently large austenite phase field for temperature and/or time latitude in the heat treatment process. In addition, the effect of Co on the martensite start, $M_s$, temperature is not as pronounced as that of Ni. Standard quench and temper protocols are not sufficient for the alloy described herein. Cryogenic treatment with a cryo-liquid (e.g., liquid nitrogen or liquid helium) to temperatures less than −300 F are required to transform the austenite that is retained after the traditional quenching operation to martensite. This cryogenic operation is performed between the quenching and tempering processes.

Ni is a required constituent and will be present in an amount sufficient to stabilize austenite. Ni is an austenite stabilizer and increases the amount of retained austenite in these alloys. Thus, the amount of Ni should be controlled to provide a predetermined maximum amount of a retained austenite phase in the alloy microstructure. In one embodiment, the predetermined maximum amount of the retained austenite phase comprises 2 percent or less (i.e., 0-2%) by volume of the alloy microstructure. In other embodiments, the predetermined amount of retained austenite phase comprises about 0-1.5%, 0.5-2%, or 0.5-1.5% by volume of the alloy microstructure. In one embodiment, the amount of Ni comprises about 1.0 to about 3.0 weight percent, and more particularly, about 1.0 to about 2.0, and yet more particularly about 1.0 to about 1.5 weight percent. The predetermined maximum amount of retained austenite improves the fracture toughness of the claimed alloys. Ni significantly depresses the $M_s$ temperature and the quantities disclosed herein provide a $M_s$ temperature that is compatible with the heat treatment temperatures and times disclosed herein to provide the desired martensitic structure while also promoting a desired amount of retained austenite. Ni in the amounts described herein also increases the Charpy V-notch toughness of the martensitic stainless steel alloys described herein. Ni is added to promote austenite formation during austenization and minimize delta ferrite formation. Excess levels of retained austenite is undesirable in this alloy because it increases susceptibility of the microstructure to corrosive attack. The presence of austenite in the microstructure creates galvanic couples with adjacent martensite leading to accelerated attack in aqueous corrosive media. Retained or untransformed austenite creates galvanic couples with adjacent martensite. Accordingly, retained austenite content should be kept below a maximum of 2% by volume of the alloy microstructure to ensure the best resistance to corrosion pitting.

As noted, C (carbon) is a required constituent and will be present in an amount sufficient to provide a predetermined hardness and/or a predetermined tensile strength. The amount of C is also selected to avoid the formation of coarse $M_{23}C_6$ carbides. These carbides preferentially nucleate at grain boundaries and cause reduced toughness. Chromium carbides also deplete the matrix surrounding the carbide of chromium, leading to a reduction of corrosion resistance. In one embodiment, C is present in an amount less than about 0.05 weight percent. In another embodiment, C is present in an amount of about 0.020 to about 0.40 weight percent, and more particularly about 0.20 to about 0.30 weight percent, and even more particularly about 0.025 weight percent. In one embodiment, the predetermined hardness is about 30 to about 42 HRC, and the predetermined ultimate tensile strength (UTS) is about 150 to about 200 ksi. The amount of C may be used together with a low temperature tempering heat treatment, as described herein, to provide a predetermined strength and a predetermined fracture toughness that are sufficient for use as turbine airfoil components, including turbine compressor vanes and blades, and more particularly turbine compressor vanes and blades suitable for use in the first through fifth stages of an industrial gas turbine compressor.

Referring to the FIG. 1, according to another aspect, a method 100 of making a forged, martensitic, corrosion pitting resistant, stainless steel alloy is disclosed. The method 100 includes providing 110 a forged preform of a martensitic, corrosion pitting resistant stainless steel alloy comprising, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities. The stainless steel alloys can be provided in any suitable manner, including being processed by substantially conventional methods. For example, the alloy may be produced by electric furnace melting with argon oxygen decarburization (AOD) ladle refinement, followed by electro-slag remelting (ESR) of the ingots. Other similar melting practices may also be used. A suitable forming operation, such as various forging methods, may then be employed to produce bar stocks and forging preforms that have a precursor shape of the desired article, including the various articles described herein, such as, for example, turbine compressor airfoils.

The method 100 also includes heating 120 the forged preform to a solutionizing temperature for a time sufficient to form a solutionized microstructure. In one embodiment, the solutionizing temperature comprises about 2,000° F. to about 2,100° F. and the solutionizing time comprises about 1 hour to about 3 hours.

The method further includes cooling 130 the forged preform and solutionized microstructure to room temperature to form a martensitic microstructure. Any suitable method of cooling may be employed that provides a cooling rate sufficient to promote a martensitic transformation of the alloy microstructure. In one embodiment, cooling comprises water, polymer, or oil quenching. Gas or air quenching are insufficient to prevent the formation of sigma phase during cooling. More specifically, a cooling rate of 0.25° C./sec is required to suppress sigma phase formation in highly alloyed stainless steels.

The method additionally includes immersing 140 the forged preform in a cryo-liquid at a temperature of less than −300° F. The cryo-cooling transforms the retained austenite phase to martensite. Cryogenic treatment is performed with a cryo-liquid (e.g., liquid nitrogen or liquid helium) to temperatures less than −300° F., and is required to transform the austenite that is retained after the traditional quenching operation to martensite. This cryogenic operation is performed between the quenching/cooling 130 and tempering/heating 150 process steps.

The method also includes heating 150 the forged preform to a tempering temperature of about less than 600° F. for a predetermined tempering time sufficient to form a tempered forged preform comprising a tempered martensitic microstructure. Any suitable heating method and tempering time may be employed. In one embodiment, the predetermined tempering time is about 3 hours to about 6 hours. In one embodiment, the tempered forged preform comprises a turbine airfoil preform or a compressor airfoil preform. Low tempering temperatures, below 600° F., are utilized to avoid the formation of the precipitates described herein, particularly the embrittling chi, laves, and sigma phases. It has been shown that when more than 3.5% Mo is present in a 12% Cr steel there is a high-temperature aging reaction based on the precipitation of the laves phase. High Mo contents can also result in the high temperature formation of the intermetallic chi and sigma phases which give rise to brittleness and low tensile ductility. The formation of these compounds result in a dramatic loss in impact resistance. Consequently, the focus will be on solid solution strengthening (from both substitutional elements and interstitial carbon) and low-temperature tempering at a temperature of lower than 600° F. The low temperature tempering also establishes a predetermined maximum operating temperature of these alloys that is less than the tempering temperature, preferably at least about 50 to about 100° F. lower than the tempering temperature to avoid subsequent tempering of the martensite and changes to the alloy microstructure. It is desirable to keep as much Cr and Mo as possible in solution to provide corrosion resistance and not have the elements bound in intermetallic compounds or carbides. The formation of sigma phase either during quenching or tempering is a concern. Sigma phase formation is detrimental to corrosion resistance and toughness. The tempering temperature is kept below 600 F to prevent the formation of sigma, chi, and laves phases which embrittle the alloy and reduce corrosion pitting resistance.

In addition to resistance to corrosion pitting, the martensitic stainless steels alloys disclosed herein have a combination of strength, ductility, and fracture toughness that makes them suitable for use to form various turbine airfoil, blade and other components. In one embodiment, the martensitic stainless steel alloys exhibited better corrosion pitting resistance than GTD-450 and GTD-450+ after salt fog exposure for 500 hours in accordance with ASTM G85, and in another embodiment exhibited substantially no corrosion pitting after 500 hours of exposure in accordance with ASTM G85, which may also be described in an embodiment as no corrosion pitting in conjunction with this salt fog exposure. In another embodiment, the martensitic stainless steels alloys disclosed herein exhibited substantially no corrosion pitting after 1,000 hours of salt fog exposure in accordance with ASTM B117, which may also be described in an embodiment as no corrosion pitting in conjunction with this salt fog exposure. In one embodiment, the martensitic stainless steels alloys have an ultimate tensile strength of about 150 ksi or more, and more particularly about 150 to about 200 ksi. In another embodiment, the martensitic stainless steels alloys have a room temperature elongation of about 11 percent. In yet another embodiment, the martensitic stainless steels alloys have a tensile reduction in area of about 39 percent. In yet another embodiment, the martensitic stainless steels alloys have a Charpy V-notch impact toughness of about 20 Joules (16 ft-lbs).

The alloys and methods disclosed herein may be used to form turbine airfoil components, including those used for compressor airfoil components of industrial gas turbines. A typical compressor airfoil in the form of a turbine compressor blade is well known. A compressor blade has a leading edge, a trailing edge, a tip edge and a blade root, such as a dovetailed root that is adapted for detachable attachment to a compressor disk. The span of a blade extends from the tip edge to the blade root. The surface of the blade comprehended within the span constitutes the airfoil surface of the turbine airfoil. The airfoil surface is that portion of the turbine compressor airfoil that is exposed to the flow path of air from the turbine inlet through the compressor section of the turbine into the combustion chamber and other portions of the turbine. While the alloys and methods disclosed herein are particularly useful for use in turbine compressor airfoils in the form of turbine compressor blades and vanes, they are broadly applicable to all manner of turbine compressor airfoils used in a wide variety of components. These include turbine airfoils associated with turbine compressor vanes and nozzles, shrouds, liners and other turbine compressor airfoils, i.e., turbine components having airfoil surfaces such as diaphragm components, seal components, valve stems, nozzle boxes, nozzle plates, or the like. Also, while these alloys and methods are useful for gas turbine compressor blades and vanes, they can potentially also be used for the turbine components of industrial steam turbines, including compressor blades and vanes, steam turbine buckets and other steam turbine airfoil components, oil and gas machinery components, as well as other applications requiring high tensile strength, fracture toughness and resistance to pitting corrosion so long as the operating temperature range of the components is compatible with the predetermined maximum operating temperature of the alloys as described herein.

The terms "a" and "an" herein do not denote a limitation of quantity, but rather denote the presence of at least one of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25 weight percent (wt. %), more particularly about 5 wt. % to about 20 wt. % and even more particularly about 10 wt. % to about 15 wt. %" are inclusive of the endpoints and all intermediate values of the ranges, e.g., "about 5 wt. % to about 25 wt. %, about 5 wt. % to about 15 wt. %", etc.). The use of "about" in conjunction with a listing of constituents of an alloy composition is applied to all of the listed constituents, and in conjunction with a range to both endpoints of the range. Finally, unless defined otherwise, technical and scientific terms used herein have the same meaning as is commonly understood by one of skill in the art. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

It is to be understood that the use of "comprising" in conjunction with the alloy compositions described herein specifically discloses and includes the embodiments wherein the alloy compositions "consist essentially of" the named components (i.e., contain the named components and no other components that significantly adversely affect the basic and novel features disclosed), and embodiments wherein the alloy compositions "consist of" the named components (i.e., contain only the named components except for contaminants which are naturally and inevitably present in each of the named components).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

Further aspects of the invention are provided by the subject matter of the following clauses:

A method of making a forged, martensitic, stainless steel alloy, comprising, providing a forged preform of martensitic, pitting corrosion resistant stainless steel alloy comprising, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities, wherein the alloy has a microstructure that comprises a retained austenite phase at least about 15 percent by volume of the microstructure; heating the forged preform to a solutionizing temperature for a time sufficient to form a solutionized microstructure; cooling the forged preform and solutionized microstructure with a liquid to room temperature, and subsequently; immersing the forged preform in a cryo-liquid to transform the retained austenite phase in the microstructure to martensite; heating the forged preform to a tempering temperature of less than 600° F. for a tempering time sufficient to form a tempered forged preform comprising a tempered martensitic microstructure; and cooling the tempered forged preform to room temperature.

The method of any preceding clause, wherein the solutionizing temperature comprises about 2,000 to about 2,100° F. and the time comprises about 1 to about 3 hours.

The method of any preceding clause, wherein the liquid in the cooling step comprises oil or water, and the forged preform and solutionized microstructure is immersed in the liquid.

The method of any preceding clause, wherein the cryo-liquid in the immersing step comprises liquid nitrogen, or liquid helium.

The method of any preceding clause, wherein the tempering time is about 3 hours to about 6 hours.

The method of any preceding clause, wherein the tempered forged preform comprises a turbine airfoil preform or a compressor airfoil preform.

The method of any preceding clause, wherein the retained austenite phase comprises less than or equal to 2 percent by volume of the microstructure.

The method of any preceding clause, wherein the alloy has a microstructure that contains substantially no laves phase, no chi phase, or no delta ferrite phase.

The method of any preceding clause, wherein the alloy has a microstructure that comprises substantially no sigma phase.

A method of making a forged, martensitic, stainless steel alloy, comprising: providing a forged preform of martensitic, pitting corrosion resistant stainless steel alloy comprising, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities, wherein the alloy has a microstructure that comprises a retained austenite phase less than or equal to 2 percent by volume of the microstructure; heating the forged preform to a solutionizing temperature for a time sufficient to form a solutionized microstructure; cooling the forged preform and solutionized microstructure with a liquid to room temperature, wherein the liquid is an oil and the forged preform is immersed in the oil, and subsequently; immersing the forged preform in a cryo-liquid to transform the retained austenite phase in the microstructure to martensite, wherein the cryo-liquid is liquid nitrogen or liquid helium, and is at a temperature of less than −300° F.; heating the forged preform to a tempering temperature of less than 600° F. for a tempering time sufficient to form a tempered forged preform comprising a tempered martensitic microstructure; and cooling the tempered forged preform to room temperature.

The method of the preceding clause, wherein the alloy has a microstructure that comprises substantially no sigma phase.

A forged, martensitic, stainless steel alloy comprising, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities; and wherein the alloy has a microstructure that comprises a retained austenite phase less than or equal to 2 percent by volume of the microstructure.

The alloy of any preceding clause, wherein the alloy has a microstructure that comprises substantially no sigma phase.

The alloy of any preceding clause, wherein the alloy has a microstructure that contains substantially no laves phase, no chi phase, and no delta ferrite phase.

The alloy of any preceding clause, wherein the alloy comprises a turbine airfoil preform or a compressor airfoil preform.

A forged, martensitic, stainless steel alloy comprising, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities; and wherein the alloy has a microstructure that comprises substantially no sigma phase.

The alloy of the preceding clause, wherein the alloy has a microstructure that comprises a retained austenite phase less than or equal to 2 percent by volume of the microstructure.

The alloy of any preceding clause, wherein the alloy has a microstructure that contains substantially no laves phase, no chi phase, and no delta ferrite phase.

The alloy of any preceding clause, wherein the alloy comprises a turbine airfoil preform or a compressor airfoil preform.

The invention claimed is:

1. A method of making a forged, martensitic, stainless steel alloy, comprising:

providing a forged preform of martensitic, pitting corrosion resistant stainless steel alloy comprising, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities, wherein the alloy has a microstructure that comprises a retained austenite phase less than 2 percent by volume of the microstructure;

heating the forged preform to a solutionizing temperature for a time sufficient to form a solutionized microstructure;

preventing formation of sigma phase in the solutionized microstructure while forming a martensitic microstructure by cooling the forged preform and solutionized microstructure with a liquid to room temperature at a rate of about 0.25° C./sec., and subsequently;

immersing the forged preform in a cryo-liquid to transform at least a portion of the retained austenite phase in the microstructure to martensite;

heating the forged preform to a tempering temperature of less than 600° F. for a tempering time sufficient to form a tempered forged preform comprising a tempered martensitic microstructure; and cooling the tempered forged preform to room temperature, wherein the forged, martensitic, stainless steel alloy has a Charpy V-notch impact toughness of about 20 Joules (16 ft-lbs.).

2. The method of claim 1, wherein the solutionizing temperature comprises about 2,000 to about 2,100° F. and the time comprises about 1 to about 3 hours.

3. The method of claim 1, wherein the liquid in the cooling step comprises oil or water, and the forged preform and solutionized microstructure is immersed in the liquid.

4. The method of claim 1, wherein the cryo-liquid in the immersing step comprises liquid nitrogen, or liquid helium.

5. The method of claim 1, wherein the tempering time is about 3 hours to about 6 hours.

6. The method of claim 1, wherein the tempered forged preform comprises a turbine airfoil preform or a compressor airfoil preform.

7. The method of claim 1, wherein the alloy has a microstructure that contains no laves phase, no chi phase, or no delta ferrite phase.

8. A method of making a forged, martensitic, stainless steel alloy, comprising:

providing a forged preform of martensitic, pitting corrosion resistant stainless steel alloy comprising, by weight: about 12.0 to about 16.0 percent chromium; greater than 16.0 to about 20.0 percent cobalt, about 6.0 to about 8.0 percent molybdenum, about 1.0 to about 3.0 percent nickel, about 0.020 to about 0.040 percent carbon; and the balance iron and incidental impurities, wherein the alloy has a microstructure that comprises a retained austenite phase less than or equal to 2 percent by volume of the microstructure;

heating the forged preform to a solutionizing temperature for a time sufficient to form a solutionized microstructure;

preventing formation of sigma phase in the solutionized microstructure while forming a martensitic microstructure by cooling the forged preform and solutionized microstructure with a liquid to room temperature at a rate of about 0.25° C./sec., wherein the liquid is an oil and the forged preform is immersed in the oil, and subsequently;

immersing the forged preform in a cryo-liquid to transform at least a portion of the retained austenite phase in the microstructure to martensite, wherein the cryo-liquid is liquid nitrogen or liquid helium, and is at a temperature of less than −300° F.;

heating the forged preform to a tempering temperature of less than 600° F. for a tempering time sufficient to form a tempered forged preform comprising a tempered martensitic microstructure; and cooling the tempered forged preform to room temperature, wherein the forged, martensitic, stainless steel alloy has a Charpy V-notch impact toughness of about 20 Joules (16 ft-lbs.).

* * * * *